US010082030B2

(12) United States Patent
Genrup et al.

(10) Patent No.: US 10,082,030 B2
(45) Date of Patent: Sep. 25, 2018

(54) THERMODYNAMIC CYCLE OPERATING AT LOW PRESSURE USING A RADIAL TURBINE

(71) Applicant: Climeon AB, Danderyd (SE)

(72) Inventors: Magnus Genrup, Lund (SE); Olle Bergström, Tyresö (SE); Joachim Karthauser, Sollentuna (SE); Kari Munukka, Åkersberga (SE); Esko Ahlbom, Uppsala (SE); Per Askebjer, Åkersberga (SE)

(73) Assignee: Climeon AB, Stockholm (SE)

( * ) Notice: Subject to any disclaimer, the term of this patent is extended or adjusted under 35 U.S.C. 154(b) by 86 days.

(21) Appl. No.: 15/113,374

(22) PCT Filed: Jan. 20, 2015

(86) PCT No.: PCT/SE2015/050046

§ 371 (c)(1),
(2) Date: Jul. 21, 2016

(87) PCT Pub. No.: WO2015/112075

PCT Pub. Date: Jul. 30, 2015

(65) Prior Publication Data

US 2017/0037728 A1 Feb. 9, 2017

(30) Foreign Application Priority Data

Jan. 22, 2014 (SE) ..... 1400027
Apr. 7, 2014 (SE) ..... 1400186
(Continued)

(51) Int. Cl.
*F01D 5/04* (2006.01)
*F01K 25/10* (2006.01)
(Continued)

(52) U.S. Cl.
CPC ..... *F01D 5/04* (2013.01); *F01D 1/06* (2013.01); *F01D 15/10* (2013.01); *F01K 7/16* (2013.01);
(Continued)

(58) Field of Classification Search
CPC ... F01D 5/04; F01D 15/10; F01D 1/06; F01K 25/103; F01K 23/18; F01K 23/06; F01K 7/16; F01K 25/08; F05D 2220/31
(Continued)

(56) References Cited

U.S. PATENT DOCUMENTS 2,102,637 A 12/1937 Ulrich
4,009,575 A 3/1977 Hartman, Jr. et al.
(Continued)

FOREIGN PATENT DOCUMENTS

CN 101101158 A 1/2008
CZ 302037 B6 9/2010
(Continued)

OTHER PUBLICATIONS

Sauret, et al., "Candidate radial-inflow turbines and high-density working fluids for geothermal power systems", Energy 2011, vol. 36, Issue 7, pp. 4460-4467.
(Continued)

*Primary Examiner* — Hoang Nguyen
(74) *Attorney, Agent, or Firm* — Haynes Beffel and Wolfeld LLP; Ernest J. Beffel, Jr.; Andrew L. Dunlap

(57) ABSTRACT

Expansion machines in thermodynamic cycles operate at low pressures, i.e. below 10 bar. The interplay among components including gas generator, expansion machine, heat exchangers and pressure reduction device (absorber or condenser) is optimized, resulting in configurations operating at the lowest achievable cost level. A single stage radial turbine characterized by a pressure ratio of 5-10, a dimen-
(Continued)

sionless speed of about 0.7 and a loading coefficient of 0.7 is a preferred expansion machine for certain thermodynamic cycles involving CO2 gas to permit such radial turbines to operate close to their optimum design specification and highest efficiency level. Methods to handle liquids which may condense within or inside the turbine are also disclosed, as well as methods to handle axial pressure on bearings and methods to protect lubricant in bearings.

18 Claims, 1 Drawing Sheet

(30) Foreign Application Priority Data

Aug. 13, 2014 (SE) ..... 1400384
Oct. 21, 2014 (SE) ..... 1400492

(51) Int. Cl.
*F01K 23/18* (2006.01)
*F01K 7/16* (2006.01)
*F01K 25/08* (2006.01)
*F01D 1/06* (2006.01)
*F01D 15/10* (2006.01)
*F01K 23/06* (2006.01)

(52) U.S. Cl.
CPC ..... *F01K 23/06* (2013.01); *F01K 23/18* (2013.01); *F01K 25/08* (2013.01); *F01K 25/103* (2013.01); *F05D 2220/31* (2013.01)

(58) Field of Classification Search
USPC ..... 415/203
See application file for complete search history.

(56) References Cited

U.S. PATENT DOCUMENTS

| | | | | |
|---|---|---|---|---|
| 4,031,712 | A | 6/1977 | Costello | |
| 4,066,381 | A | 1/1978 | Earnest | |
| 4,512,394 | A | 4/1985 | Kauffman | |
| 4,774,858 | A * | 10/1988 | Ganoung | B60W 10/06 477/100 |
| 5,398,497 | A | 3/1995 | Suppes | |
| 5,408,747 | A | 4/1995 | Fredmonski et al. | |
| 5,557,936 | A | 9/1996 | Drnevich | |
| 6,209,307 | B1 | 4/2001 | Hartman | |
| 6,269,644 | B1 | 8/2001 | Erickson et al. | |
| 6,668,554 | B1 | 12/2003 | Brown | |
| 7,019,412 | B2 | 3/2006 | Ruggieri et al. | |
| 7,685,820 | B2 | 3/2010 | Litwin et al. | |
| 9,429,046 | B2 | 8/2016 | Ostrom et al. | |
| 2005/0111980 | A1* | 5/2005 | Negulescu | F01D 5/081 416/97 R |
| 2005/0193758 | A1 | 9/2005 | Wells | |
| 2008/0047502 | A1 | 2/2008 | Morse | |
| 2009/0071153 | A1 | 3/2009 | Boyapati et al. | |
| 2009/0158739 | A1 | 6/2009 | Messmer | |
| 2009/0287011 | A1 | 11/2009 | Evans et al. | |
| 2010/0077752 | A1 | 4/2010 | Papile | |
| 2010/0154419 | A1 | 6/2010 | Kontomaris | |
| 2010/0212318 | A1 | 8/2010 | Schaal | |
| 2010/0236242 | A1 | 9/2010 | Farsad et al. | |
| 2010/0251711 | A1 | 10/2010 | Howes et al. | |
| 2011/0265501 | A1 | 11/2011 | Nir | |
| 2011/0308252 | A1 | 12/2011 | Kopecek et al. | |
| 2013/0038055 | A1 | 2/2013 | Ostrom et al. | |
| 2013/0105110 | A1 | 5/2013 | Mills | |
| 2013/0160450 | A1* | 6/2013 | Cogswell | F01K 25/08 60/657 |
| 2013/0280036 | A1 | 10/2013 | Jan et al. | |
| 2015/0112075 | A1 | 4/2015 | Yang et al. | |
| 2016/0201521 | A1 | 7/2016 | Karthauser | |

FOREIGN PATENT DOCUMENTS

| | | | |
|---|---|---|---|
| DE | 102004006837 | A1 | 8/2005 |
| EP | 1103699 | A2 | 5/2001 |
| EP | 1925785 | A1 | 5/2008 |
| EP | 2128386 | A1 | 12/2009 |
| EP | 2669473 | A1 | 12/2013 |
| JP | S55149641 | A | 11/1980 |
| SE | 9504683 | L | 6/1997 |
| WO | 9627075 | A1 | 9/1996 |
| WO | 0066887 | A1 | 11/2000 |
| WO | 2004104399 | A1 | 12/2004 |
| WO | 2006124776 | A2 | 11/2006 |
| WO | 2008074637 | A1 | 6/2008 |
| WO | 2011130981 | A1 | 10/2011 |
| WO | 2012116174 | A1 | 8/2012 |
| WO | 2012128715 | A1 | 9/2012 |
| WO | 2014042580 | A1 | 3/2014 |
| WO | 2015034418 | A1 | 3/2015 |
| WO | 20160076779 | A1 | 5/2016 |

OTHER PUBLICATIONS

Harinck et al., Computational Study of a high-expansion ratio radial organic rankine cycle turbine stator:, ASME, Journal of Engineering for Gas Turbines and Power, vol. 132, Issue 5, May 2010.
PCT/SE2015/050046—International Search Report and Written Opinion dated Jul. 30, 2015, 17 pages.
U.S. Appl. No. 13/582,369—Office Action dated Sep. 2, 2014, 18 pages.
U.S. Appl. No. 13/582,369—Response to Sep. 2 Office Action filed Oct. 17, 2014, 12 pages.
U.S. Appl. No. 13/582,369—Office Action dated Nov. 7, 2014, 18 pages.
U.S. Appl. No. 13/582,369—Response to Nov. 7 Office Action filed Dec. 23, 2014, 14 pages.
U.S. Appl. No. 13/582,369—Office Action dated May 6, 2015, 19 pages.
U.S. Appl. No. 13/582,369—Response to May 6 Office Action filed Jul. 28, 2015, 13 pages.
U.S. Appl. No. 13/582,369—Office Action dated Sep. 11, 2015, 19 pages.
U.S. Appl. No. 13/582,369—Response to Sep. 11 Office Action filed Dec. 7, 2015, 21 pages.
Begamudre, Rakosh Das, "Energy Conversion Systems," ISBN:81-224-1266-1, New Age International Limited, Publishers, Copyright 2000, p. 266.
Robbins, T. and Garimella, S., "Low-Grade Waste Heat Recovery for Power Production using an Absoption-Rankine Cycle" (2010), International Refrigeration and Air Conditioning Conference. Paper 11547, Purdue University Jul. 12-15, 2010, 9 pages.
Chen, H., et al., "A Review of Thermodynamic Cycles and Working Fluids for the Conversion of Low-grade Heat," Clean Energy Research Center, Renewable and Sustainable Energy Reviews, 2010 Elsevier Ltd., 9 pages.
PCT/SE2014/050991—International Search Report dated Dec. 19, 2014, 5 pages.
PCT/SE2012/050319—International Search Report and Written Opinion dated Jun. 7, 2012, 11 pages.
PCT/SE2012/050319—European Search Report dated Oct. 13, 2015, 9 pages.
EP 14842782—Extended European Search Report dated Jun. 6, 2017, 3 pages.
PCT/SE2014/050991—International Written Opinion dated Dec. 19, 2014, 9 pages.
PCT/SE2015/051181—International Search Report and Written Opinion dated May 19, 2016, 13 pages.
PCT/SE2015/051181—International Preliminary Report on Patentability dated May 16, 2017, 9 pages.
U.S. Appl. No. 13/582,369—Notice of Allowance dated Dec. 22, 2015, 12 pages.
U.S. Appl. No. 13/582,369—Supplemental Notice of Allowance dated Apr. 13, 2016 Dec. 2015, 22 pages.

(56) References Cited

OTHER PUBLICATIONS

U.S. Appl. No. 13/582,369—Response to Office Action dated Sep. 2, 2014, filed Oct. 17, 2014, 12 pages.
U.S. Appl. No. 15/236,136—Office Action dated Oct. 6, 2017, 33 pages.
SE 1400492-3—Office Action dated May 26, 2015, 8 pages.

* cited by examiner

THERMODYNAMIC CYCLE OPERATING AT LOW PRESSURE USING A RADIAL TURBINE

FIELD OF THE INVENTION

This invention relates to thermodynamic cycles and useful expansion machines.

BACKGROUND AND PRIOR ART

The PCT documents SE 2012 050 319 and SE 2013/051 059 (assigned to Climeon AB) disclose a novel thermodynamic cycle using CO2 gas as working fluid and alkaline liquids (amines) as temporary and reversible CO2 absorbents. CO2 is liberated from CO2-saturated amines in the hot section (e.g. 90° C.), generating 1-10 bar pressure, and, following expansion through a turbine, absorbed by non-saturated amine in the cold section of the process. The steady-state pressure in the cold section is significantly below atmospheric pressure such that pressure ratios between the hot and cold side of the process between 25 and 4 can be realized. Variations and improvements are disclosed in SE 1300 576-4, SE 1400 027-7 and SE 1400 160-6, all assigned to Climeon, hereby incorporated by reference.

General background relating to expansion machines is found in the following disclosures and references:

Moustapha, Zelesky, Baines & Japikse, "Axial and radial turbines", Concepts NREC, 2003, ISBN 0-933283, see especially FIG. 8.19. Japikse & Baines, "Introduction to turbomachinery". Balje O., "Turbomachines—A Guide to Design Selection and Theory", 1981, ISBN 0-471-06036-4.

Among patent disclosures, EP 2 669 473 (Mitsubishi, 2012) and US 2013/0280 036 (Honeywell) are recent examples of technological progress in the construction of radial turbines. U.S. Pat. No. 5,408,747 (United Technologies Corp., 1994) describes a CFD approach to the design of radial-inflow turbines.

Regarding the removal of condensing liquids from the turbine during the expansion, the following disclosures are of general interest: EP 2092 165 by ABB (2007), EP 2128 386 by Siemens (2008), EP 1925 785 by Siemens (2006), EP 1103 699 by Mitsubishi (2007), EP 0812 378 by Joel H. Rosenblatt (1995). The latter publication discloses the management of two-phase systems such as ammonia-water in multi-stage turbines. This invention differs from the a.m. disclosures in the sense that one-stage radial turbines are employed which pose very different challenges compared to axial turbines.

For the invention, it is relevant to appreciate that expansion machines can be selected on the basis of the Cordier/Balje diagram of dimensionless parameters including the rotation frequency, average volume flow and the isentropic heat drop. Comparing axial and radial turbines, the optimum performance range of axial turbines as function of the dimensionless specific speed is rather broad. By contrast, radial turbines have a rather narrow range where the turbine efficiency is above 80, or >85 or >88% of theoretical maximum. Provided the dimensionless specific speed is about 0.7 (range 0.5-0.9), a single stage radial turbine can be as efficient as a one- or two-stage axial turbine (see Balje).

BRIEF DESCRIPTION OF THE INVENTION

Figure 1:
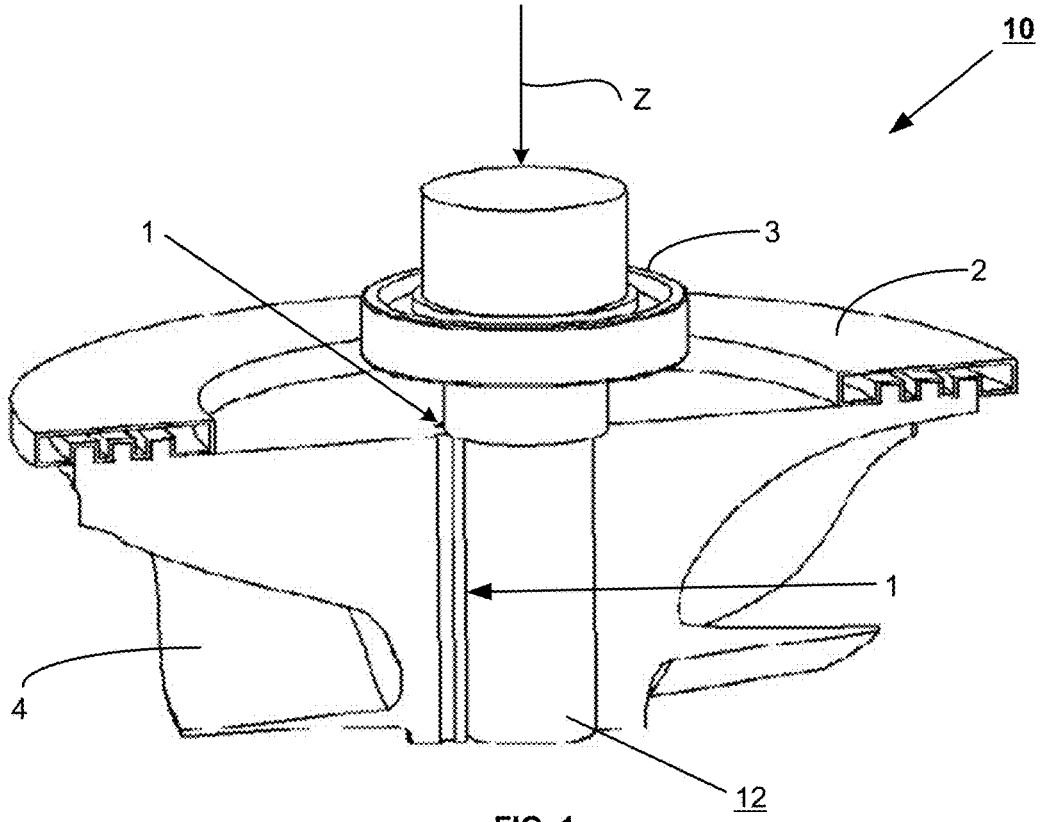
FIG. 1 shows an embodiment of a radial turbine with specific features. The turbine blades are arranged on an axle defining the Z direction. From the side, high pressure gas, e.g. between 1-3 bars enters the turbine and acts on blades 4. The turbine is stabilized by at least one bearing 3. A labyrinth 2 reduces gas flow from the high pressure side to the top side of the turbine and the bearing space. At least one hole 1, but typically a plurality roughly in z-direction, allows high pressure gas to escape the bearing space towards the low pressure regime at the bottom of FIG. 1.

Given that the C3 thermodynamic cycle as disclosed in SE 2012 050 319 and SE 2013/051 059 as well as SE 1300 576-4, SE 1400 027-7 and SE 1400 160-6, hereby incorporated by reference, can generate pressure ratios of far above 10, the natural choice of a suitable expansion machine is an axial multi-stage turbine. However, in the desired effect range of 100 kW electricity production, few products are available, and both the design and production of suitable axial turbines are very or even prohibitively expensive. Surprisingly, it was found by the inventors that the C3 process can be adjusted by proper choice of chemistry and working fluid composition (absorption enthalpy in the range of preferably 700-1400 kJ/kg CO2, and suitable evaporation enthalpies of co-solvents in the range of 200-1100, preferably 300-800 kJ/kg solvent,), heat exchangers etc., such that a significantly cheaper single stage radial turbine can be employed at the optimum point of performance, where axial and radial turbines perform equally well. It appears counter-intuitive to employ a turbine most suitable for a pressure of about 8 when the system would allow the use of multi-stage turbines and pressure ratios of >>10 on the basis of pressure generation capability at high temperature, and vacuum generation capability at low temperature. However, careful modelling of the single stage configuration and the associated flows (saturated amine, unsaturated amine, both volatile or non-volatile as defined by boiling points above or below 100° C. at atmospheric pressure, CO2 gas, solvents) reveals the unexpected benefits. As far as limitations of the configuration are concerned, systems with absorption enthalpies below 700, below 800, below 900, or 1000 or 1100 kJ/kg CO2 would be characterized by very large liquid flows unless the temperature on the hot side is raised to above 100° C. It should be clear that the optimum configuration from a cost point-of-view is found by modelling, and balancing costs of especially the turbine and the necessary heat exchangers.

DETAILED DESCRIPTION OF PREFERRED EMBODIMENTS

This invention concerns in one aspect a method to generate electricity from low value heat streams such as industrial process heat, heat from engines or geothermal or solar heat at the lowest cost possible, i.e. with economic equipment resulting in low depreciation costs. Surprisingly, radial turbines offer not only reasonable costs, but they also offer certain technical advantages, such as: A radial turbine can be designed without bearings on the exit side. This offers the possibility of having a highly-effective diffuser for optimum turbine performance. The required bearings will be on the alternator side of the unit (commonly referred to as "overhang". There will therefore be no need for bearing struts in the diffuser. The diffuser recovery will be improved if no struts are present in the flow path.

Further, no shaft seal is needed in the low pressure regime. By virtue of the "overhang design" of the bearings, the turbine has no shaft-seal on the low-pressure (or absorber) side. This means that the risk of air leaking into the cycle is effectively removed.

Also, the "swallowing capacity"/choking effect can be used advantageously, allowing to let the rotational frequency control upstream pressure. An un-choked radial turbine has a rather large speed influence on the turbine swallowing capacity (i.e. the flow-pressure-temperature-relation). This feature can be used to optimize the cycle pressure, hence chemistry, at various off-design conditions, by varying the turbine speed. The turbine speed is controlled by the power electronics.

Finally, the diffusor can be integrated into the absorption chamber 24 in various ways, at a 0-90 degree angle, generating swirl etc in order to ensure maximum interaction of gas and liquid absorbent. The diffusor may be placed vertically or horizontally or at any angle. The turbine diffuser and the absorber can be combined into a single part, where the absorption process starts already in the turbine diffuser, provided that nozzles can be placed without too severe aerodynamic blockage. Providing a liquid flow on the inner walls of the diffusor is an option to prevent build-up of residues such as ice or crystals in the diffuser.

Turbine design: as temperature is low, the aerodynamic profile can be optimized since no scalloping will be required. The C3 temperature level is lower than e.g. in automotive applications and there is no need for additional stress reduction such as removing the hub at the turbine inlet. The efficiency of the turbine can be increased by two to four points by avoiding the scalloping. This feature is unique for the C3-cycle with a radial turbine. No scalloping needed=supporting elements on the downstream side of the turbine wheel, to improve the mechanical stability in case of exposure to high temperature. No compromise is required.

The invention enables the use of cheaper materials for construction, including thermoplastics or glass/carbon fiber reinforced thermosets or thermoplastics, as a direct consequence of low maximum temperatures (60-120° C.) and low pressures (<10 bar) prevalent in the C3 process and its embodiments as described above. Also the preferred rotation speed of the turbine in the range of 18000 to 30000 revolutions per minute (rpm), preferably between 20000 and 25000 revolutions per minute, fits to cheap engineering materials.

In one embodiment, the turbine design is modified to enable the removal of a condensing liquid. Said liquid may e.g. be amine or water or any component which condenses first from a composition of at least two working fluids. Condensing liquids in general may cause erosion, corrosion, and a lowering of the obtainable efficiency, e.g. due to friction, changed inlet angle etc. In axial turbines, removal of condensing liquid is state-of-the-art, however, in radial turbines no designs have been published. For the application according to the invention, a preferred embodiment includes the positioning of slits or openings downstream of the inlet channels 18, but upstream of the rotating blades. At that position, a significant pressure is available for removing condensing liquid. Liquid may be transported away from the turbine towards the condenser using said pressure difference through pipes and optional valves. Said valves may be triggered by sensors which detect the presence of liquid, e.g. by measuring heat conductivity.

In one embodiment of the above solution to remove condensing liquid, it may be beneficial to also extract condensing liquid prior to working gas/fluid entering the stator or the inlet channels 18. Working gas enters the space upstream of the stator, and especially during start-up of the machine, some fluid/gas may condense.

From a process point-of-view, the disclosed combination of radial turbines and the C3 process fits to most of the systems and chemistries described in the a.m. disclosures.

In a specific embodiment, a working fluid composition of a) amines such as dibutylamine or diethylamine, 0-80% by weight, b) solvent selected from the group consisting of acetone (preferred due to its excellent expansion characteristics), isopropanol, methanol and ethanol, at least 20% by weight and c) CO2, not more than 0.5 mol per mol amine, and d) optionally water (0-100% by weight) is chosen. The working gas entering the turbine comprises a mixture of CO2, amine, solvent and optionally water at a ratio defined by the process parameters and the working fluid composition. The exact composition of the working gas is preferably chosen such that the working gas expands in a "dry" mode, i.e. avoiding condensation and drop formation on the turbine blades.

In one embodiment, water is part or constitutes 100% of the working fluid composition. Whilst water is affecting the partial pressures of all components, benefits relating to fire risks result. Further, the absorption enthalpies of the amine/CO2 reaction is reduced.

In one embodiment, volatile amines such as diethylamine (DEA) are employed. DEA has a boiling point of 54° C. and is therefore part of the working gas and is removed from the equilibrium of amine and CO2. This result in complete CO2 desorption from the carbamate based on CO2 and DEA. This mode of operation obviates the need for using a central heat exchanger, or allows to use a smaller heat exchanger.

In one embodiment, non-volatile amines such as dibutylamine (DBA) are employed.

In one embodiment relating to turbine technology and the risk of solvents dissolving lubricants in bearings, magnetic bearings are employed. Alternatively, the bearing space is continuously evacuated, or a small gas stream, e.g. CO2, is led into the bearing space at a slightly higher pressure than prevalent in the process, such that solvent condensation in the bearing space is avoided. Gas leaking from the bearing space into the process can be evacuated e.g. using techniques described in as yet unpublished patent applications.

Figure 2:
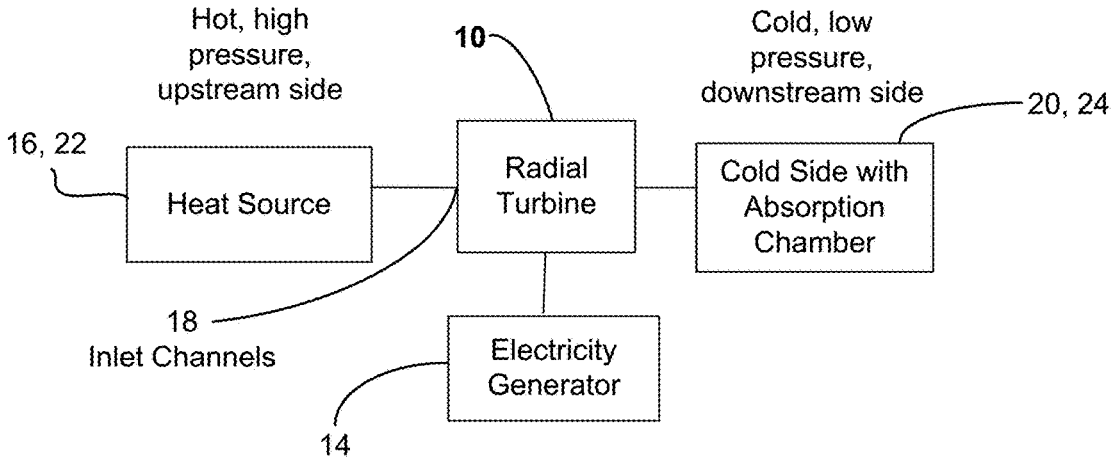
FIG. 2 is a simplified schematic representation of basic components of a thermodynamic cycle system.

In one embodiment, further relating to minimizing the risk that lubricant is removed or washed out from bearings, but also relating to the risk that bearings wear out prematurely due to non-ideal loads in axial or radial direction, the turbine is modified in a way which is further shown in FIGS. 1 and 2 showing an embodiment of a radial turbine 10 with specific features. The turbine blades 4 are arranged on an axle 12 defining the Z direction. From the side, high pressure gas, e.g. between 1-3 bars enters the turbine and acts on blades 4. The turbine is stabilized by at least one bearing 3. A labyrinth seal 2 reduces gas flow from the high pressure side to the top side of the turbine and the bearing space. At least one hole 1, but typically a plurality roughly in z-direction, allows high pressure gas to escape the bearing space towards the low pressure regime at the bottom of FIG. 1. Typical dimensions for a 100 kW turbine may be: hole diameter 1-6 mm, turbine height in z direction 90 mm. A range of hole diameters is given. The diameter may be different for different working media. The important criterion for selecting balancing hole geometries is, that the pressure drop over all balancing holes shall be lower than the pressure drop over the labyrinth. As a consequence, the labyrinth seal serves as bottleneck, and the pressure in the bearing space is reduced and approaches the pressure downstream of the turbine. This embodiment is preferred because the bearings are exposed to a minimum of chemicals which may dissolve lubricant. Further, gas pressure in z direction on the turbine, causing undesirable pressure and load on bearing 3 is minimized by at least 20%, or 30%, or 40%, or 50%, or 60% or 75% or more as the pressure is at least reduced accordingly by 20%, or 30%, or 40%, or 50%, or 60%, or 75% or more. Improved embodiments may comprise a load cell which dynamically adjusts the distance between labyrinth and rotating turbine and keeps it to a minimum value. The labyrinth may be made of polymeric materials.

In one embodiment, the purpose of the turbine modification, namely the reduction of the gas pressure in the space where the bearing is placed, is achieved by fluidly connecting said space by a pipe or bypass leading towards the low pressure side, i.e. the absorber or condenser. Said pipe may comprise a valve which can be regulated. Another bypass from the high pressure gas side into the bearing space, with a regulating valve, may serve to adjust the pressure and the axial load onto the bearings. Various configurations are conceivable, e.g. a solution with two labyrinth seal sections with different diameters whereby the inner section between the smallest labyrinth seal and the axle is kept at minimum pressure in order to protect the bearing, and the section between the two labyrinth seals is kept at higher pressure to adjust the axial load on the bearing.

One special advantage of the solutions described here is that the electrical generator 14 which may be in fluid connection with the bearing space can be kept at low pressure. This prevents condensation of working medium also in the generator. The solution involves a small loss such as between 0.1 and 5% of high pressure gas which otherwise would be available for power generation, however, the benefits such as prevention of working liquid condensation in the generator or on the bearing and the reduction of undesirable forces onto the bearings, and therefore extended lifetime of the turbine, outweigh the loss.

In one embodiment, from known bearing solutions for turbines, such as roller bearings, magnetic bearings and the like, a hydrostatic bearing is chosen. In a preferred embodiment, the working gas or medium or fluid itself is carrying the load. This solution is especially preferred in case a solvent such as acetone, isopropanol or water is used as working fluid. The working fluid may be pumped into the space between the static parts and the rotating parts by means of a pump, e.g. an external separate pump or a process pump which is pumping working fluid within the system. The pressure may be in the interval 2-10 bar, preferably below 5 bar. The rotational speed is preferably in the range 20000-30000 rpm for power generation systems producing 50-200 kW but may be much higher (>100000) for small-scale systems, e.g. 10 kW systems. One particular advantage of hydrostatic bearings, apart from enabling high rotational speeds, is that lubricant or grease in conventional bearings is not needed in hydrostatic bearings. There would otherwise be a certain risk that lubricant or components in lubricant such as mineral oil would be extracted from the bearing area. This would deplete the bearing from necessary lubricant, and the extracted lubricant component would accumulate in the process.

It should be understood that the concepts in the different embodiments may be combined.

All embodiments are characterized by the fact that below atmospheric pressure prevails on the cold or absorption/condensation side of the process. Depending on temperature of the cooling stream, the pressure may be <0.8 bar, <0.7 bar, <0.6 bar or preferably <0.5 bar. This pressure can be maintained by providing cooling in the absorber, e.g. a heat exchanger, and/or by recirculating condensed working fluid and cooling said liquid inside or outside of the absorption/condensation chamber as described elsewhere.

In FIGS. 1 and 2 the reference characters have the following meaning:

1 balancing hole through turbine axle (one of a plurality)
2 labyrinth, to reduce gas flow from the side to bearing space
3 bearing
4 turbine blade
10 radial turbine
12 axle
14 electricity generator
16 heat source
18 inlet channels
20 cold side
22 hot side
24 absorption chamber
Z=direction of axle

ORIGINAL CLAIMS AS CLAUSES

The following clauses describe aspects of various examples of thermodynamic operating methods and systems.

1. A method to operate a thermodynamic cycle involving a working gas/fluid or a or working gas/fluid composition whereby said working gas/fluid or working gas/fluid composition passes from the hot to the cold side (20) of the cycle through an expansion machine operating at low pressures, i.e. below 10 bar maximum pressure, and provided with a electricity generator so as to generate electricity, characterized by a) employing a single stage radial turbine as expansion machine, said turbine operating at a dimensionless speed in the range of 0.55-0.85, and an optimum loading factor of 0.7 b) adapting the ratio of pressures before and downstream of said turbine in the range of 4.5-10, more preferably 6-9, most preferably 7-8, lower values being preferred when the heat source (16) is of lower temperature, c) selecting the working gas/fluid or working gas/fluid composition from CO2, solvent such as acetone, isopropanol, methanol, ethanol, amine such as diethylamine, optionally water at any ratio, d) further selecting the working gas/fluid or working gas/fluid composition such that at the cold side of the process, i.e. in the absorption or condensation section, a maximum pressure (<) below 0.8 bar, preferably <0.7 bar, <0.6 bar, or most preferably <0.5 bar under dynamic conditions is maintained, e) using absorbent fluids comprising amines in case CO2 is the working gas/fluid or part of the working gas/fluid composition for reversibly absorbing or desorbing CO2 especially for regulating the pressure quote before/after the turbine, f) selecting a heat source from the group consisting of geothermal heat, solar heat, industrial waste heat and heat from combustion processes, wherein the heat source used has a temperature within the range of 60-120° C., preferred in the range of 70-95° C.

2. The method according to clause 1, wherein the electricity production per turbine employed is in the range of 10-600 kW, preferably in the range of 50-300 kW or 80-180 kW and most preferably in the range of 120-160 kW.

3. The method according to clauses 1 or 2, wherein the rotation speed of said single stage radial turbine is in the range of 1800 to 30000 revolutions per minute (rpm), preferably 20-25000 rpm.
4. The method according to anyone of the preceding clauses, wherein the gas speed at the guide vane exit of said single stage radial turbine is within the range of Mach 0.8-1.2, preferably within the range of 0.85-1.1.
5. The method according to anyone of the preceding clauses, wherein a chemical composition of the CO2-absorbing medium is chosen such that the CO2 absorption enthalpy as calculated from a van't Hoff graph (representation of equilibrium pressure versus temperature) is in the range of 700-1800 kJ/kg CO2, more preferably 900-1600 kJ/kg CO2, most preferably 1000-1400 kJ/kg CO2 and whereby the temperature on the hot/cold side are in the range of 60-120° C./0-40° C.
6. The method according to anyone of the preceding clauses, wherein a turbine wheel of said single stage radial turbine is not supported by a bearing on the downstream or low pressure side of the turbine, and wherein the electricity generator is placed on the same axis as the turbine wheel, but on the opposite side of a diffusor.
7. The method according to anyone of the preceding clauses, wherein the electricity generator and associated electronics is used to sustain the gas pressure on the inlet side of the turbine via regulation of the rotational frequency of the turbine wheel.
8. The method according to anyone of the preceding clauses, wherein at least one hydrostatic bearing is chosen for the turbine, and where the working gas or working fluid is selected from solvents preferably comprising acetone, butanol, isopropanol, ethanol, amines and water or solvent mixtures.
9. A system comprising single stage radial turbine, wherein a working gas/fluid, comprising CO2, downstream of the turbine is led through a diffusor into at least one absorption chamber where the working gas/fluid is condensed and/or where the CO2 is absorbed by amines, and wherein said diffusor is placed such that the working gas/fluid is moving in a swirling mode within the absorption chamber(s) which may comprise a heat-exchanging condenser.
10. The system according to clause 9, wherein the CO2 concentration of the working gas/fluid is adjusted, i.e. reduced or increased, to an available heat source such that the optimum pressure quote is maintained, thus allowing increased electricity production.
11. The system according to clauses 9 or 10, wherein condensing liquid is partly or wholly removed in the single stage radial turbine, e.g. through slits positioned downstream of the stationary working gas/fluid inlet channels, but upstream of rotating blades, and/or slits positioned upstream of the inlet channels of the turbine, whereby said condensed liquid is preferably led to the condenser in a controlled manner
12. The system according to anyone of the clauses 9 to 11, wherein the turbine blade is perforated, e.g. by drilling at least one hole (1) from the low pressure side to the high pressure side, or where a bypass pipe leading from the high pressure side, specifically from a gas/fluid space where the bearing (3) and the generator are located to the low pressure side, specifically the absorber, said bypass pipe is optionally controlled by a valve, such that a minor but sufficient amount high pressure gas/fluid, impeded by a labyrinth or equivalent construction, can escape from the gas/fluid space of the bearing (3) towards the low pressure side and the absorber or condenser, resulting in lowering the pressure in the gas/fluid space where the bearing is located.
13. The system according to anyone of the clauses 9 to 12, wherein pressure or absolute force onto the bearing, or typically two bearings (3), in axial or z-direction, caused by high pressure gas/fluid acting onto the turbine wheel in said z-direction, is reduced by at least 20%, or 30%, or 40%, or 50%, or 60%, or 75% or more by letting an amount of at least 20%, or 30%, or 40%, or 50%, or 60%, or 75% or more of high pressure gas/fluid in the gas/fluid space of the bearing (3) escape to the low pressure side.

The invention claimed is:

1. A method to operate a thermodynamic cycle involving a working gas/fluid whereby the working gas/fluid passes from a hot, upstream side to a cold, downstream side of the thermodynamic cycle through a system comprising an inlet channel, an expansion machine operating at pressures below 10 bar maximum pressure, and an electricity generator operably coupled to the expansion machine so as to generate electricity, wherein the method comprises:

employing a single stage radial turbine as the expansion machine;

wherein the single stage radial turbine comprises a high pressure side, an inlet at the high pressure side coupled to the inlet channel, a low pressure side and rotating turbine blades arranged on an axle defining a Z direction, and wherein the single stage radial turbine is operated at a dimensionless speed in a range of 0.55-0.85;

receiving heat from a heat source that is at least one of the following: geothermal heat, solar heat, industrial waste heat and heat from combustion processes, wherein the heat used has a temperature within a range of 60-120° C.;

passing a working gas/fluid through the single stage radial turbine comprising at least one of CO2, solvent, amine, and water;

partly or wholly removing condensing liquid in the single stage radial turbine away from the single stage radial turbine towards an absorption chamber by at least one of allowing the condensing liquid to escape downstream of the inlet channel, but upstream of the rotating turbine blades, and allowing the condensing liquid to escape upstream of the inlet channel;

operating the single stage radial turbine at a ratio of pressures on the hot, upstream side versus the cold, downstream side of the thermodynamic cycle to be in a range of 6-9; and maintaining a pressure on a cold side of a thermodynamic process below 0.8 bar by providing cooling to the working gas/fluid on the cold side.

2. The method according to claim 1, wherein the single stage radial turbine is operated at a loading coefficient of about 0.7.

3. The method according to claim 1, wherein:

CO2 is the working gas/fluid, and the ratio of pressures operating step is carried out using absorbent fluids comprising amines for reversibly absorbing or desorbing CO2.

4. The method according to claim 1, wherein the ratio of pressures is in a range of 7-8.

5. The method according to claim 1, wherein the pressure maintaining step comprises maintaining the pressure on the cold side of the thermodynamic process below 0.5 bar.

6. The method according to claim 1, wherein the single stage radial turbine has a rotational speed in a range of 18,000 to 30,000 revolutions per minute (rpm).

7. The method according to claim 1, wherein the working gas/fluid is selected from solvents comprising at least one of acetone, butanol, isopropanol, ethanol, amines and water or solvent mixtures.

8. The method according to claim 1 wherein, when CO2 is the working gas/fluid, the method further comprises:

leading the working gas/fluid downstream of the single stage radial turbine through a diffusor into the absorption chamber, where the working gas/fluid is condensed, wherein the diffusor is arranged such that the working gas/fluid moves in a swirling mode within the absorption chamber.

9. The method according to claim 1, further comprising:

reducing a pressure acting onto the turbine blades in the Z direction by at least 20% by letting an amount of at least 20% of the working gas/fluid at a high pressure side escape to the low pressure side.

10. The method according to claim 1, further comprising:

reducing a pressure acting onto the turbine blades in the Z direction by at least 75% by letting an amount of at least 75% of the working gas/fluid at a high pressure side escape to the low pressure side.

11. A system to be used in a thermodynamic cycle involving a working gas/fluid passing from a hot, upstream side to a cold, downstream side of the thermodynamic cycle, the system comprising:

an inlet channel;

an expansion machine fluidly coupled to the inlet channel and operating at pressures below 10 bar maximum pressure;

wherein the expansion machine is a single stage radial turbine comprising a high pressure side, an inlet at the high pressure side coupled to the inlet channel, a low pressure side and rotating turbine blades arranged on an axle defining a Z direction, wherein the single stage radial turbine is operable at a dimensionless speed in a range of 0.55-0.85, wherein the expansion machine receives heat from a heat source that is at least one of the following: geothermal heat, solar heat, industrial waste heat and heat from combustion processes, the received heat having a temperature within a range of 60-120° C., wherein a working gas/fluid is passed through the single stage radial turbine and the working gas/fluid includes at least one of CO2, solvent, amine and water, and wherein the single stage radial turbine operates at a ratio of pressures on the hot, upstream side versus the cold, downstream side of the thermodynamic cycle to be in a range of 6-9;

an absorption chamber or condenser where the working gas/fluid is condensed or absorbed, wherein the absorption chamber or condenser provides cooling to the working gas/fluid and wherein a pressure on a cold side of a thermodynamic process is maintained below 0.8 bar; and an electricity generator operably coupled to the expansion machine so as to generate electricity.

12. The system according to claim 11, wherein the single stage radial turbine is stabilized by at least one bearing arranged in a gas/fluid space on the high pressure side of the single stage radial turbine.

13. The system according to claim 12, wherein the single stage radial turbine comprises a flow-restricting path to allow escape of an amount of high pressure gas/fluid from the gas/fluid space towards the low pressure side, resulting in lowering a pressure in the gas/fluid space.

14. The system according to claim 13, wherein the flow-restricting path comprises a gas flow reducing labyrinth seal.

15. The system according to claim 11, wherein the turbine blades are perforated with at least one hole from the low pressure side to the high pressure side.

16. The system according to claim 14, wherein the single stage radial turbine comprises a bypass leading from the high pressure side to the low pressure side.

17. The system according to claim 16 is, wherein the bypass comprises a valve controlling flow through the bypass.

18. The system according to claim 16, wherein the bypass comprises at least one balancing hole along the axle roughly in the Z direction.

* * * * *